US009186565B2

(12) United States Patent
English

(10) Patent No.: US 9,186,565 B2
(45) Date of Patent: Nov. 17, 2015

(54) PHYSICAL TRAINING APPARATUS

(76) Inventor: Doug English, Austin, TX (US)

( * ) Notice: Subject to any disclaimer, the term of this patent is extended or adjusted under 35 U.S.C. 154(b) by 494 days.

(21) Appl. No.: 13/189,019

(22) Filed: Jul. 22, 2011

(65) Prior Publication Data

US 2013/0023388 A1 Jan. 24, 2013

(51) Int. Cl.

*A63B 69/00* (2006.01)
*A63B 21/06* (2006.01)
*A63B 23/04* (2006.01)

(52) U.S. Cl.

CPC ..... *A63B 69/002* (2013.01); *A63B 21/0602* (2013.01); *A63B 21/0603* (2013.01); *A63B 23/047* (2013.01)

(58) Field of Classification Search

CPC .... A63B 21/072; A63B 21/075; A63B 21/06; A63B 21/0603; A63B 21/1469; A63B 21/0602; A63B 21/1496; A63B 2210/50; A63B 21/0601; A63B 69/345; A63B 21/028; A63B 69/002; A63B 23/047

USPC ..... 482/93, 83–90, 51, 68, 148, 136; 220/288, 601, 659; 473/422, 438, 473/441–443, 439, 440; 601/112

See application file for complete search history.

(56) References Cited

U.S. PATENT DOCUMENTS 1,269,559 A * 6/1918 Fauver et al. ..... 473/441
2,059,318 A * 11/1936 De Merce ..... 220/592.19
2,078,530 A * 4/1937 Courtright et al. ..... 220/288
2,179,125 A * 11/1939 Kirlin ..... 114/219
2,334,360 A * 11/1943 St John ..... 482/86
2,341,740 A * 2/1944 Penney ..... 220/592.19
2,538,682 A * 1/1951 Gramelspacher ..... 217/72
2,782,956 A * 2/1957 Richman ..... 220/592.2
3,111,317 A * 11/1963 Cituk ..... 473/444
3,985,257 A * 10/1976 Shaffer et al. ..... 220/669
4,103,889 A * 8/1978 Lobur ..... 482/86
4,469,324 A 9/1984 Dolan
4,527,796 A * 7/1985 Critelli ..... 482/86
4,712,711 A * 12/1987 Geering et al. ..... 220/254.2
5,417,635 A * 5/1995 Sell ..... 482/105
5,462,272 A 10/1995 Staten
5,624,358 A * 4/1997 Hestilow ..... 482/90
5,918,757 A * 7/1999 Przytulla et al. ..... 220/288
6,106,443 A * 8/2000 Kuo ..... 482/83
6,234,940 B1 * 5/2001 Fotsis ..... 482/83
6,251,051 B1 * 6/2001 Chen ..... 482/83
6,261,195 B1 7/2001 Shingleton
6,612,971 B1 * 9/2003 Morris ..... 482/74
7,040,501 B1 * 5/2006 Przytulla ..... 220/659
7,217,201 B2 5/2007 Sealy (Continued)

*Primary Examiner* — Loan H Thanh
*Assistant Examiner* — Andrew S Lo
(74) *Attorney, Agent, or Firm* — Meyertons, Hood, Kivlin, Kowert & Goetzel, P.C.

(57) ABSTRACT

Physical training systems that may promote effective technique and strength training for various sports, as well as general strength and fitness training. Apparatus may require a user to push and lift in a coordinated manner to effectively overcome inertia and rolling resistance. The training apparatus may include a cylindrical core portion and compliant outer portion located on an outer surface of the core portion. In use, the training apparatus may rotate around a center axis of the core portion when a sufficient force, exceeding a resistance level, is received by the training apparatus (e.g., as a result of a user exercising proper technique in applying force to the training apparatus). The resistance level may be a result of a configurable amount of ballast contained within the apparatus.

14 Claims, 5 Drawing Sheets

(56) References Cited

U.S. PATENT DOCUMENTS

| | | | | |
|---|---|---|---|---|
| 7,322,893 | B2 | 1/2008 | Bright | |
| 7,322,905 | B2 * | 1/2008 | Morris | 482/74 |
| 7,527,568 | B2 | 5/2009 | Joseph | |
| 7,648,450 | B2 | 1/2010 | Munson, Jr. | |
| 8,231,511 | B2 * | 7/2012 | Dalcourt | 482/106 |
| 2002/0072455 | A1 * | 6/2002 | Akins | 482/93 |
| 2002/0086780 | A1 * | 7/2002 | Morris | 482/136 |
| 2005/0187075 | A1 * | 8/2005 | Bellamy | 482/93 |
| 2005/0209074 | A1 * | 9/2005 | Barrows | 482/148 |
| 2008/0096740 | A1 * | 4/2008 | Nichols | 482/121 |
| 2008/0153676 | A1 * | 6/2008 | Krietzman | 482/93 |
| 2009/0029833 | A1 * | 1/2009 | Lin | 482/93 |
| 2009/0101649 | A1 * | 4/2009 | Kuzelka | 220/288 |
| 2009/0312159 | A1 * | 12/2009 | Gilliam | 482/93 |
| 2011/0152035 | A1 * | 6/2011 | Wahl | 482/51 |
| 2011/0287904 | A1 * | 11/2011 | Morris | 482/93 |
| 2011/0300995 | A1 * | 12/2011 | Castiglione | 482/51 |
| 2012/0157269 | A1 * | 6/2012 | Fu et al. | 482/86 |
| 2012/0283072 | A1 * | 11/2012 | Jones et al. | 482/93 |
| 2014/0162849 | A1 * | 6/2014 | Engle et al. | 482/93 |

* cited by examiner

PHYSICAL TRAINING APPARATUS

BACKGROUND

This disclosure relates generally physical training equipment, and more specifically to exercise and sports training equipment. Various embodiments of the present disclosure are well-suited to strength and technique training, particularly as relating to football.

Various sports, such as football, rugby, wrestling, hockey, basketball, lacrosse, and baseball may require an athlete to exert force to move an opposing athlete, or to resist the opposing athlete's movement. For example, a football player may be called upon to block an opposing player, or to resist an opposing player's efforts to block that that particular player. Similarly, a baseball catcher attempting to tag a base runner may be called upon to resist the base runner's efforts to collide with the catcher with sufficient force to dislodge the baseball from the catcher's grasp.

Many similar situations exists throughout various sports. In such situations, an untrained athlete often will push with a horizontal force, without the benefit of lowering his or her center of gravity by bending at the knees. In contrast, a well-trained athlete learns through instruction and repetitive training to bend the knees, roll the hips, and to push and lift in order to more effectively move or stifle the movement of the opposing athlete. Subsequently, when tasked with moving the opposing athlete, the well-trained athlete will continue pushing and lifting while moving forward with knees bent, a lowered center of gravity, and a well-coordinated movement involving the hands, arms, feet, and hips to continue to effectively move the opposing athlete.

SUMMARY

Various structures and techniques for providing a physical training system are disclosed. The disclosed structures may require a user to push and lift in a coordinated manner to effectively overcome inertia and rolling resistance, thereby promoting the user to exert force and move in an effective manner, using an effective body posture. Accordingly, use of the disclosed structures and techniques may promote effective technique and strength training that is particularly useful in various sports, including for example football, rugby, wrestling, hockey, basketball, lacrosse, and baseball. Use of the disclosed structures and techniques may also be well suited for physical training aimed at general strength and fitness improvement.

Various embodiment of a training apparatus may include a cylindrical core portion and compliant outer portion located on an outer surface of the core portion. In use, the training apparatus may rotate around a center axis of the core portion when a sufficient force, exceeding a resistance level, is received by the training apparatus (e.g., as a result of a user exercising proper technique in applying force to the training apparatus). Particular embodiments may include ballast in the core portion. In some of these embodiments, the amount of ballast held may be configurable, and the resistance level may be based at least in part on the amount of ballast.

Some embodiments of the present training apparatus may include a polygonal core portion and a compliant outer portion. The polygonal core portion may have a plurality of surfaces, and the outer portion may be located on the plurality of surfaces. The training apparatus may be configured to rotate around a center axis of the core portion when a sufficient force, exceeding a resistance level, is received by the training apparatus. Particular embodiments may include ballast in the core portion. In some of these embodiments, the amount of ballast held may be configurable, and the resistance level may be based at least in part on the amount of ballast.

Some embodiments of a training apparatus disclosed herein may include a cylindrical body that is configured to hold a user-adjustable amount of ballast within the cylindrical body. The training apparatus may be configured to rotate around a center axis of the core portion when a sufficient force, exceeding a resistance level, is received by the training apparatus. The resistance level may be based at least in part on an amount of ballast held within the cylindrical body. Particular embodiments may also include an adapter body fixed over the cylindrical body. In some of these embodiments, the adapter body may hold a user-adjustable amount of ballast. Particular embodiments of the training apparatus may also include a compliant outer portion located on an outer surface of the adapter body.

BRIEF DESCRIPTION OF THE DRAWINGS

The following detailed description makes reference to the accompanying drawings, which are now briefly described.

Figure 1:
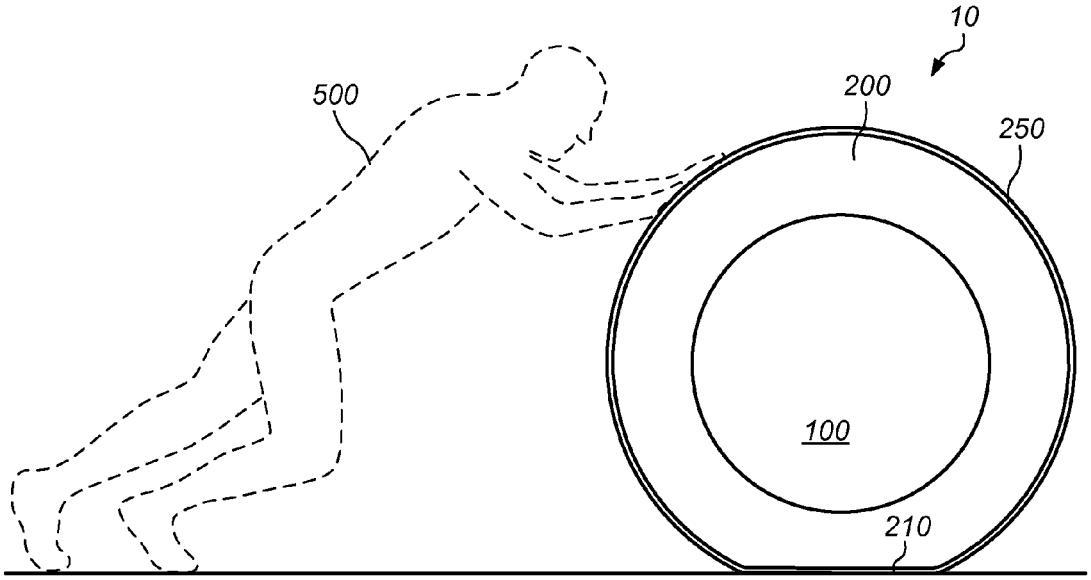
FIG. 1 depicts an embodiment of the present disclosure in use.

Specific embodiments are shown by way of example in the drawings and will be described herein in detail. It should be understood, however, that the drawings and detailed description are not intended to limit the claims to the particular embodiments disclosed, even where only a single embodiment is described with respect to a particular feature. On the contrary, the intention is to cover all modifications, equivalents and alternatives that would be apparent to a person skilled in the art having the benefit of this disclosure. Examples of features provided in the disclosure are intended to be illustrative rather than restrictive unless stated otherwise.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "first surface," "second surface," and "third surface" of a polygonal shaped core does not necessarily signify that the "second surface" is between or adjacent to the "first surface" and the "third surface" unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., an apparatus may be configured to rotate, even when the apparatus is presently at rest; an apparatus may be configured to hold some amount of ballast, even when no ballast is present).

Various components may be described as performing a task or tasks, for convenience in the description. Such descriptions should be interpreted as including the phrase "configured to." Reciting a component that is configured to perform one or more tasks is expressly intended not to invoke 35 U.S.C. §112, paragraph six, interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

Turning to FIG. 1, an illustration of one embodiment of training apparatus 10 is shown. As depicted, training apparatus 10 includes core 100 and outer portion 200. Training apparatus 10 may be configured roll along the ground, in response to force exerted by user 500, by rotating about a center axis. By virtue of the shape of training apparatus 10, user 500 may be required to exert force with both a horizontal and upward component in order to effectively move training apparatus 10. Such actions by user 500 may provide beneficial strength and technique training for general fitness, and/or for various sports, including for example football, rugby, wrestling, hockey, basketball, lacrosse, and baseball. For example, force exerted by user 500 from a stance that includes a lowered center of gravity, with knees bent, and having hips lowered and in proper alignment with the back and with the head, while the legs drive and the upper body pushes in an aligned upward and forward direction will result in the optimal efficacy in moving training apparatus 10. In contrast, pushing in a purely horizontal direction or a downward and forward direction from a more upright stance will produce much inferior results in attempting to move training apparatus 10.

Physical training using training apparatus 10 in accordance with the above-described optimal technique corresponds to the desired techniques for blocking and tackling in football. Best practices for performance of various tasks in other sports corresponds similarly. For example, the effectiveness of delivering or resisting a block in football or a check in hockey may be increased by ensuring that the body is in an alignment having a lowered center of gravity such that force may be exerted through the legs, hips, torso, shoulders, and arms in an upward and forward direction. Thus, physical training using training apparatus 10 may efficiently simulate efforts required in various sports such as football, and therefore may efficiently provide gains in strength that are particularly useful for enhancing performance in those various sports. Furthermore, repetitive training using training apparatus 10 may reinforce proper body alignment to user 500, thereby training user 500 (e.g., through increased muscle memory) to achieve improved technique for those various sports.

Continuing with FIG. 1, outer portion 200 may provide a compliant portion that serves to receive force from user 500, and also provide increased rolling resistance to training apparatus 10. For example, due to the weight of the depicted embodiment of training apparatus 10, outer portion 200 deforms at area 210. For a given weight of training apparatus 10, the rolling resistance may be increased by using a outer portion 200 that is more compliant (e.g., less rigid). The compliance of outer portion 200 also serves as a cushion to receive impacts that may be delivered via the hands (or other parts) of user 500, thereby reducing shock to the user's body. Various embodiments of outer portion 200 may include one or more of various compliant materials. For example, outer portion 200 may include a foam (e.g., a viscoelastic foam), and may be surrounded by a protective cover or coating (e.g., nylon, rubber) to protect the foam from environmental factors (e.g., rain, sunlight) and impact-related damage (e.g. shearing forces that may tend to rip or delaminate outer portion 200). In some embodiments, outer portion 200 may include a combination of different materials (e.g., multiple layers of different foams or other materials).

In some embodiments, outer portion 200 may include a protective cover or lining and a contained amount of a compliant filling material. For example, particular embodiments of outer portion 200 may include a user configurable amount of water (or other liquid) that facilitates adjustment of the compliance/stiffness of outer portion 200. Thus, in such embodiments the rolling resistance of training apparatus 10 may be adjusted by varying the amount of filling material in outer portion 200. Some of these embodiments, or other embodiments, may include outer portion 200 containing a variable amounts of a gel, and/or a gas (e.g., air, nitrogen). In some cases, outer portion 200 may include, for example, sand, gravel, cement, or other solid materials.

Adjustment of the amount of filling material within outer portion 200 may also serve as a height adjustment for training apparatus 10, whereby the height can be increased by adding an additional amount of one or more filling materials to outer portion 200. Thus, one means of adjusting the height of training apparatus 10 to accommodate users of varying heights (e.g., in use by children and adults) is provided by some embodiments of outer portion 200.

Figure 2:
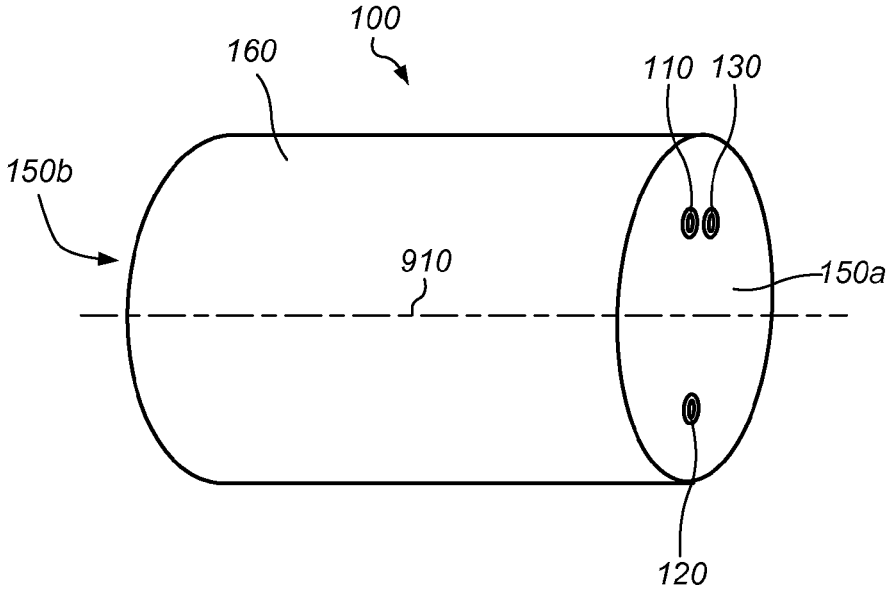
FIG. 2 depicts various aspects of one embodiment of a core that may be used in the present training apparatus. The illustrated core is configured for using ballast that may include liquids.

Turning now to FIG. 2, an example of core 100 that may be used in particular embodiments of training apparatus 10 is shown. Various embodiments of core 100 may be constructed from any suitable material or materials, including for example plastics, metals, and composite materials. Core 100 may in some cases be primarily of one-piece construction, or in other cases may be a composite of multiple components. As depicted in FIG. 2, core 100 includes outer surface 160 extending between end surface 150*a* and end surface 150*b* that are each normal to center axis 910. Embodiments of core 100 may be configured to contain a ballast material to provide training apparatus 10 with additional weight. In some embodiments, the amount of ballast material is user configurable so that the weight of training apparatus 10 may be adjusted (e.g., thereby adjusting the rolling resistance and/or the inertia of training apparatus 10). In such a way, the force required to rotate and move training apparatus 10 may be adjusted.

FIG. 2 depicts core 100 that may be well suited for use with a configurable amount of water (or other fluid) as ballast. Fill port 110 may facilitate filling of core 100 with, for example, water from a hose. Some embodiments may include fluids having higher density as ballast. In some embodiments, a combination of a fluid and a solid (e.g., water and sand, water and gravel) may be used as ballast. Drain port 120 may facilitate draining of the ballast, and vent port 130 may be useful in aiding in the filling and/or draining of the ballast. Various embodiments may include many different combinations of one or more ports, such as fill port 110, drain port 120, vent port 130, or additional ports. The ports may be of various different suitable configurations, included threaded caps, quarter-turn caps, caps retained using fasteners, valves, etc.

Figure 3:
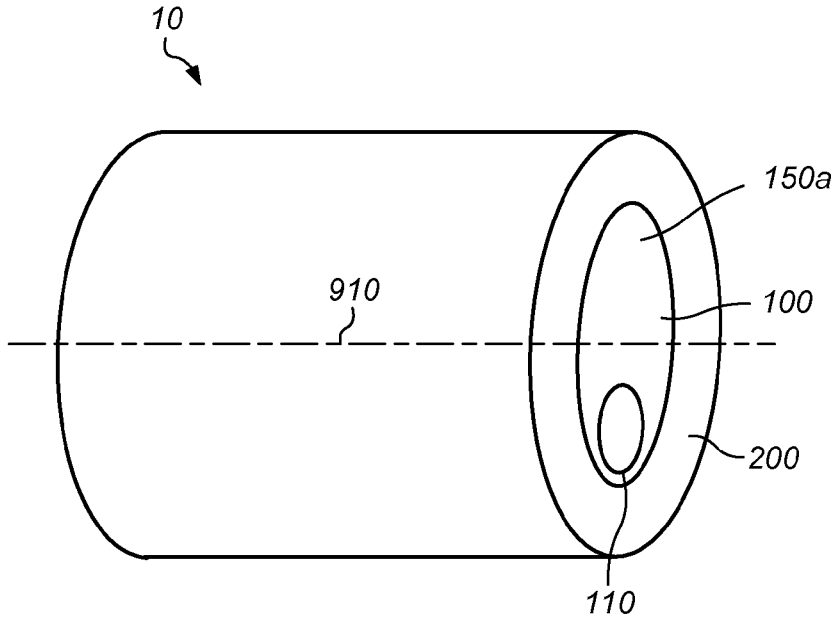
FIG. 3 shows a present embodiment that includes a core and a compliant outer portion. The depicted core is suited for using ballast that may include solid materials.

FIG. 3 depicts an embodiment of training apparatus 10 that includes outer portion 200 and core 100. Outer portion 200 may be fixed to core 100 at outer surface 160 (see FIG. 2) using various methods. For example, permanent fastening such as bonding, riveting, etc. may be used in some instances. In other cases, removable fastening such as straps, snaps, hook and loop fasteners, and other removable fastening techniques may be used. FIG. 3 depicts use of core 100 having fill port 110 that is well suited for filling or removing ballast that includes solid material (e.g., sand, gravel, cement, metal bearings).

Figure 4:
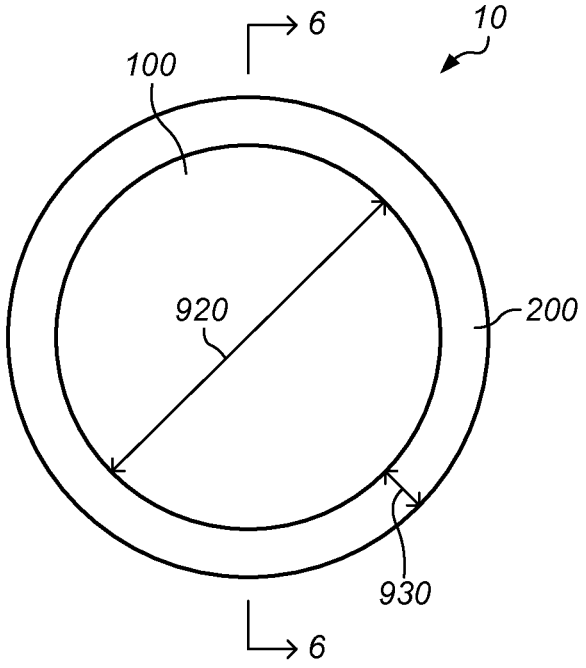
FIG. 4 is an end view of an embodiment of a training apparatus that includes a core having a circular cross section.
Figure 5:
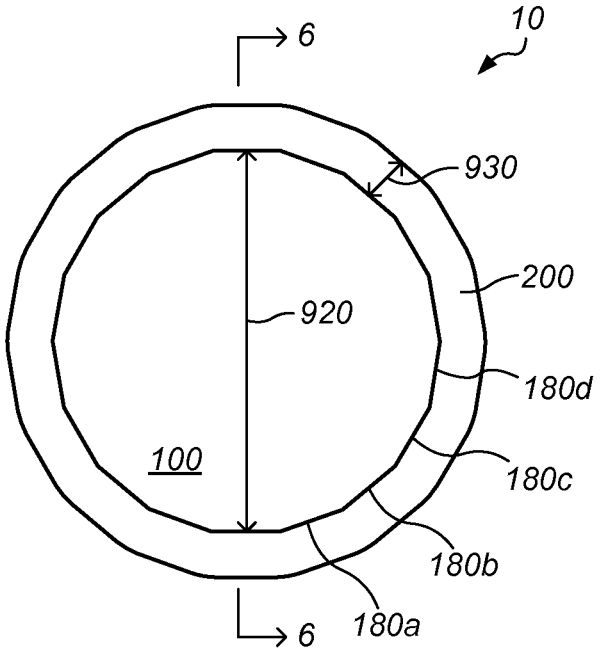
FIG. 5 is an end view of an embodiment of a training apparatus that includes a core having a polygonal cross section.
Figure 6:
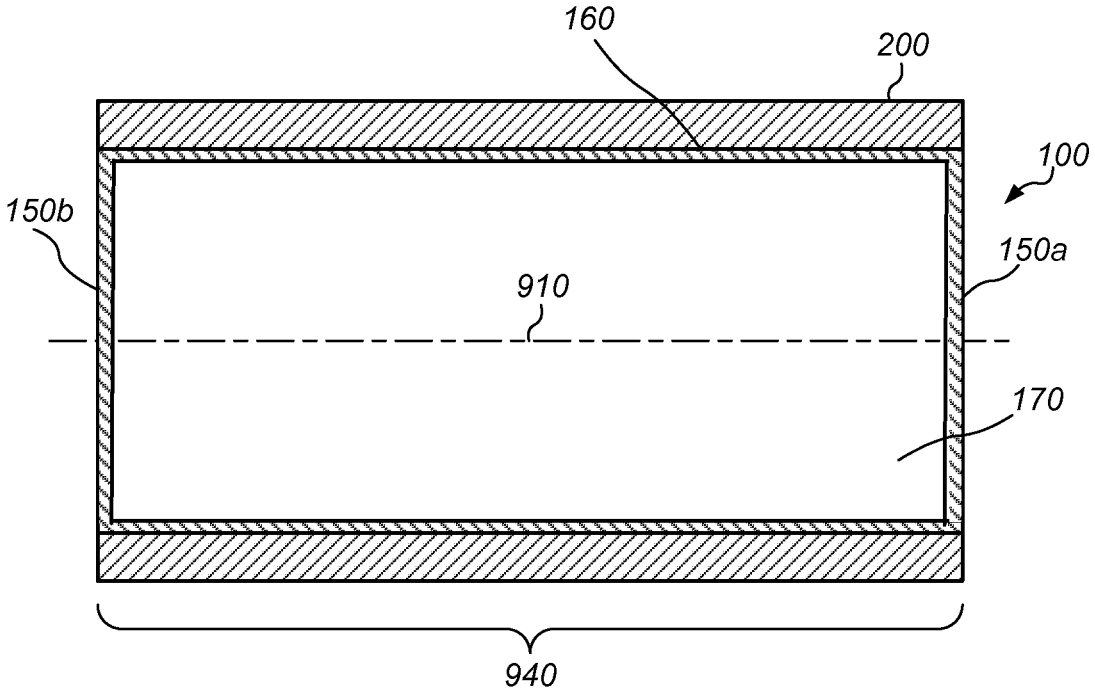
FIG. 6. is a section view of the embodiments depicted in FIG. 4 or FIG. 5, taken along Lines 6-6 of those figures.

Turning now to FIGS. 4-6, views of various embodiments of training apparatus 10 are presented to further highlight aspects of the present disclosure. FIG. 4 depicts an end view of an embodiment of training apparatus 10 that includes core 100 and outer portion 200. As noted above, different overall heights of training apparatus 10 may be desirable, depending on the user (e.g., training of youth or adults). In some embodiments, core diameter 920 of core 100 may be about 40 inches, and length 940 may be about 48 inches. In some of these embodiments, outer portion thickness 930 of outer portion 200 may be about 6 inches, resulting in training apparatus 10 having an overall height of about 52 inches. Other embodiments of training apparatus 10 may have a greater overall height due to a larger core diameter 920 and/or greater outer portion thickness 930, or a smaller overall height due to a smaller core diameter 920 and/or smaller outer portion thickness 930. As noted above, in some embodiments outer portion thickness 930 may be adjustable, thereby resulting in an adjustable overall height of training apparatus 10. Various embodiments of the present disclosure may have length 940 that is different than the above-discussed example. In some embodiments, length 940 may be much greater to accommodate two or more users simultaneously training with the same apparatus (e.g., pushing the apparatus in tandem).

FIG. 5 depicts an embodiment in which core 100 is not cylindrical, but is instead polygonal in cross section. The depicted embodiment includes and 18-sided core 100 having surfaces 180 of equal size. Other embodiments may include polygonal core 100 having 12, 16, 20, or any other number of sides, which may be of equal size or of differing size.

FIG. 6 presents a section view of particular embodiments of training apparatus 10 having either cylindrical or polygonal core 100 and outer portion 200 located at outer surface 160 of core 100. Ballast area 170 may contain a configurable amount of ballast.

Figure 7:
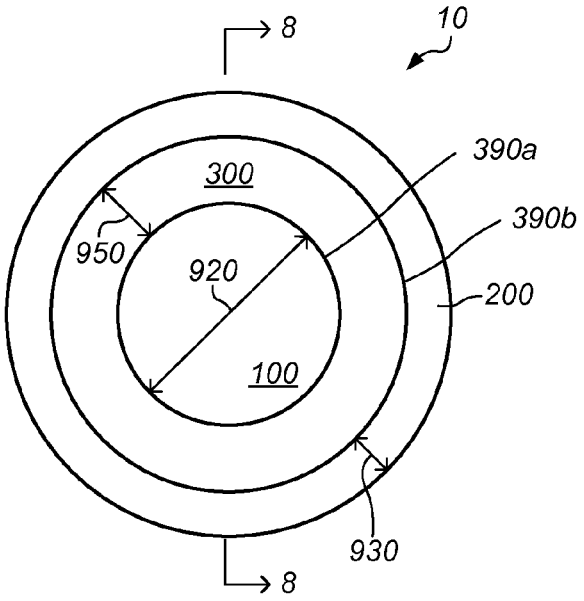
FIG. 7 is an end view of an embodiment of a training apparatus that includes a core, an adapter body, and an outer portion.
Figure 8:
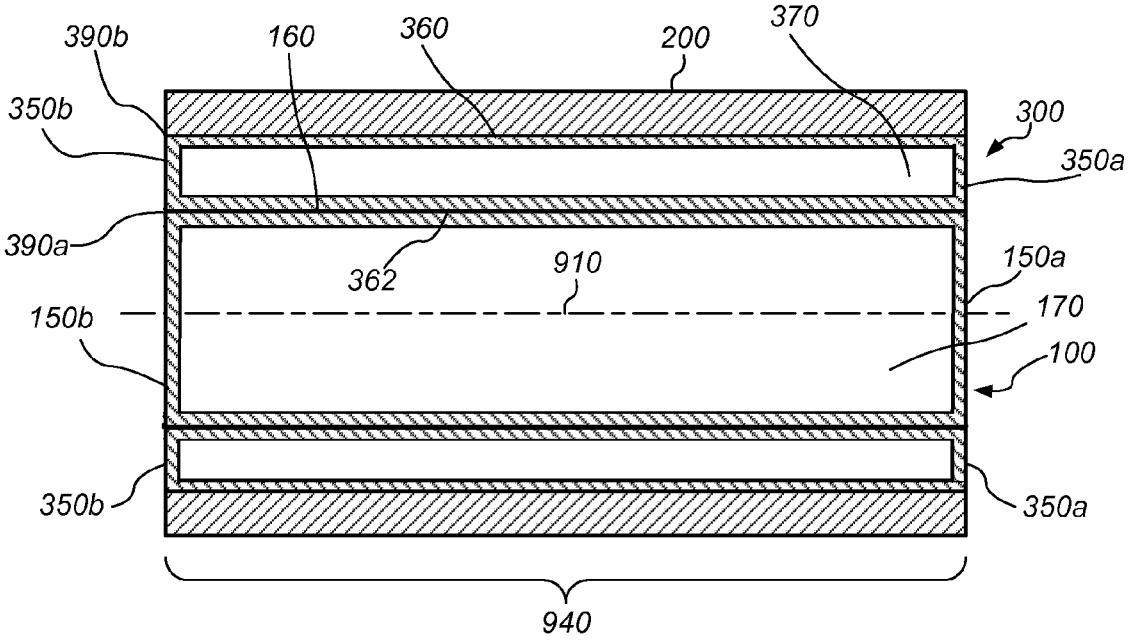
FIG. 8 is a section view of the embodiment depicted in FIG. 7, taken along Lines 8-8 of that figure.

Referring to FIGS. 7 and 8, some embodiments of training apparatus 10 may include adapter body 300 as well as core 100 and outer portion 200. Adapter body 300 may include annular shaped end surfaces 350*a* and 350*b*, with outer surface 360 and inner surface 362 extending between end surface 350*a* and end surface 350*b*. Outer surface 360 may intersect end surface 350*b* at edge 390*b*, and inner surface 362 may intersect end surface 350*b* at edge 390*a*. Various adapter body 300 of differing size may be used in some cases to configure training apparatus 10 with differing overall heights. For example, several adapter body 300 may be available for use with a particular core 100, with each adapter body 300 having inner surface 362 configured to fit over outer surface 160 of core 100. The various ones of the several adapter body 300 may have various different adapter thickness 950. Because the overall height of the embodiments training apparatus 10 depicted in FIGS. 7 and 8 is the sum of core diameter 920, adapter thickness 950, and outer portion thickness 930, the various different adapter thickness 950 may be used to provide different overall heights for training apparatus 10. In some embodiments, adapter body 300 may be configured to contain a fixed or adjustable amount of ballast at ballast area 370 (e.g., in a similar manner as ballast area 170 of core 100). Various embodiments of training apparatus 10 may include ballast area 370 and ballast area 170 that contain ballast of the same materials (e.g., both containing sand; water, concrete, gravel, metal bearings). Some embodiments may include ballast area 370 containing a particular material as ballast, and ballast area 170 containing a different material as ballast. Adapter body 300 may be fixed to core 100, and outer portion 200 may be fixed to outer surface 360 of adapter body 300.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A training apparatus configured for a user to perform sports training exercises on a horizontal ground surface, the apparatus comprising:

a rigid cylindrical core portion having a center axis, two end surfaces substantially normal to the center axis, and a circumferential outer surface extending between the two end surfaces, the core portion being hollow and configured to receive an amount of ballast via a resealable fill port positioned on one of the end surfaces; and an outer portion disposed on the outer surface of the core portion, the outer portion comprising a compliant foam portion and a protective cover portion disposed on the compliant foam portion, wherein the outer portion is deformable to have an area with a generally flat surface in contact with the ground surface, thereby providing a rolling resistance, and wherein the compliant foam portion is configured to deform in response to an impact by the user with the protective cover portion;

wherein the training apparatus is sized having a height above a waist of the user when resting on the ground surface and is configured to roll about the center axis when the user uses his or her hands to contact the protective cover portion at or above waist level to exert a force exceeding a resistance level against the training apparatus from a stance in which the user's knees are bent, wherein the exerted force includes a horizontal component that pushes the training apparatus and a vertical component that lifts the training apparatus.

2. The training apparatus of claim 1, wherein the core portion is about 40 inches in diameter, and wherein the outer portion is about 6 inches in thickness.

3. The training apparatus of claim 1, wherein the amount of the ballast held in the core portion is user configurable.

4. The training apparatus of claim 3, wherein the resistance level is further based at least in part on a configurable amount of a filling material within the outer portion.

5. The training apparatus of claim 4, wherein the filling material within the outer portion comprises air.

6. The training apparatus of claim 1, wherein a height of the training apparatus is configured to be adjusted by varying a configurable amount of a filling material within the outer portion.

7. The training apparatus of claim 1, wherein the core portion holds the ballast and wherein the ballast includes sand;

wherein an amount of the ballast is user-configurable;

wherein the core portion is about 40 inches in diameter, and wherein the outer portion is about 6 inches in thickness.

8. The training apparatus of claim 1, wherein the core portion holds the ballast.

9. A method for athletic training, comprising:

a user standing on a generally flat horizontal ground surface and positioning his or her hands at or above waist level to contact a protective cover portion of an apparatus resting on the ground surface to deform a compliant foam portion that is disposed under the protective cover portion;

the user bending his or her knees and exerting a force exceeding a resistance level against the apparatus that causes the apparatus to roll across the ground surface, wherein the exerted force includes a horizontal component that pushes the apparatus and a vertical component that lifts the apparatus;

wherein the apparatus is sized having a height above a waist of the user when resting on the ground surface and includes:

a rigid cylindrical core having a horizontal center axis substantially parallel to the surface, two end surfaces substantially normal to the center axis, and an outer surface extending between the two end surfaces, the cylindrical core being hollow and partially filled with an amount of ballast via a resealable fill port positioned on the cylindrical core, wherein the ballast includes sand; and an outer portion disposed cylindrically about the cylindrical core, the outer portion comprising the compliant foam portion and the protective cover portion, wherein the compliant foam portion is deformable to have an area with a generally flat surface in contact with the ground surface, thereby providing a rolling resistance, and wherein the compliant foam portion is configured to deform in response to contact with the protective cover portion.

10. The method for athletic training of claim 9, wherein the resistance level is configurable.

11. The method for athletic training of claim 9, further comprising:

adjusting the amount of ballast in the cylindrical core.

12. The method for athletic training of claim 10, further comprising the user lowering his or her hips prior to exerting the force.

13. The method for athletic training of claim 9, wherein the apparatus continues to present the resistance level as the apparatus rolls across the surface and the user continues to exert the force.

14. The method for athletic training of claim 10, further comprising:

adjusting a height of the apparatus by varying a configurable amount of a filling material within the compliant foam portion.

* * * * *